US006615931B2

(12) United States Patent
Dycus et al.

(10) Patent No.: US 6,615,931 B2
(45) Date of Patent: Sep. 9, 2003

(54) CONTINUOUS FEED DRILLING SYSTEM

(75) Inventors: William V. Dycus, Wytheville, VA (US); Louis E. Silay, Twain Harte, CA (US)

(73) Assignee: Boart Longyear Co., Salt Lake, UT (US)

( * ) Notice: Subject to any disclaimer, the term of this patent is extended or adjusted under 35 U.S.C. 154(b) by 0 days.

(21) Appl. No.: 10/043,081

(22) Filed: Jan. 7, 2002

(65) Prior Publication Data

US 2003/0127250 A1 Jul. 10, 2003

(51) Int. Cl.[7] ..... E21B 44/02

(52) U.S. Cl. ..... 175/27; 137/11; 175/122; 175/162

(58) Field of Search ..... 175/27, 57, 122, 175/162; 173/11, 18, 19

(56) References Cited

U.S. PATENT DOCUMENTS

| | | | | |
|---|---|---|---|---|
| 3,180,437 A | * | 4/1965 | Kellner et al. | 175/230 |
| 3,662,611 A | * | 5/1972 | Knoll | 74/22 R |
| 3,708,020 A | | 1/1973 | Adamson | |
| 4,196,914 A | | 4/1980 | Kutman et al. | |
| 4,602,797 A | | 7/1986 | Morawski et al. | |
| 4,676,312 A | | 6/1987 | Mosing et al. | |
| 4,735,270 A | | 4/1988 | Fenyvesi | |
| 4,793,421 A | * | 12/1988 | Jasinski | 175/27 |
| 5,131,475 A | * | 7/1992 | Beney | 173/1 |
| 5,544,712 A | | 8/1996 | McEwen et al. | |
| 5,791,410 A | | 8/1998 | Castille et al. | |
| 5,794,703 A | * | 8/1998 | Newman et al. | 166/381 |
| 6,003,606 A | * | 12/1999 | Moore et al. | 166/381 |
| 6,223,837 B1 | | 5/2001 | Lanzl | |

* cited by examiner

*Primary Examiner*—Hoang Dang
(74) *Attorney, Agent, or Firm*—Christie, Parker & Hale, LLP

(57) ABSTRACT

A continuous feed drilling system and controller includes a head assembly having first and second chucks synchronized to rotate at the same rotational velocity. The chucks are independently moveable within the head assembly and their positions are measured by linear transducers. The controller causes the first chuck to engage with a drill stem and begin rotating and advancing. The controller uses the outputs of the linear transducers to determine the linear velocity of the advancing first chuck and synchronize the linear velocity of the first and second chucks. The controller then causes the second chuck to engage the drill stem and causes the first chuck to release the drill stem. The process is repeated, alternating the roles of the first and second chucks, thus creating a continuous drilling motion.

22 Claims, 8 Drawing Sheets

CONTINUOUS FEED DRILLING SYSTEM

BACKGROUND OF THE INVENTION

This invention pertains generally to the field of core drilling and more specifically to core drilling systems.

A sample of earth or rock taken from a bore hole in the earth is termed a "core sample" in the fields of resource exploration and civil engineering. The core sample is used to determine the characteristics of a strata of earth or rock. A mining engineer may use a core sample to determine the extent of an ore vein, a petroleum engineer may use a core sample to determine the likelihood of finding recoverable petroleum in a strata, and a civil engineer may use a core sample to determine the strength of the bedrock underneath a large structure. Core drilling can be distinguished from borehole drilling in that the purpose of borehole drilling is to create a borehole through the earth but the purpose of core drilling is to create and retrieve a clean core sample from the length of a borehole.

A typical core bit used to collect a core sample is a hollow cylinder with a cutting surface on one face of the hollow cylinder. The core bit is fixedly attached on one end of a cylindrical pipe and inserted into a previously drilled bore hole. New sections of pipe are added to the upper end of the original pipe, creating a series of connected pipes in what is termed a drill stem, as the core bit is pushed into the borehole. Each section of pipe is on the order of 10 feet long. When the core bit reaches the bottom of the borehole, the core bit is forced against a rock strata as the core bit is rotated by rotating the drill stem. The combination of the force and the rotating cutting surface cuts a cylindrical core sample from the rock strata. The core sample is captured in an interior portion of the drill stem behind the core bit until the core sample can be retrieved from the borehole. The length of an interior tube containing a core barrel is typically five feet to 30 feet in length.

It is desirable to operate the core bit with as few changes in rotational speed and applied force as possible. An ideal operational mode for a core bit would allow the collection of a core sample without any changes in rotational speed or applied force. However, real world applications typically involve changes in both parameters while obtaining a core sample. Prior art core drilling apparatuses involve a chuck through which the drill stem passes. The chuck is movably attached to a stationary drilling platform. The chuck is typically used to apply longitudinal and rotary forces to the drill stem in order to advance the core bit. As the chuck has a limited amount of longitudinal movement, the chuck must be repositioned on a frequent basis in order to advance the core bit for the entire length of a core sample. This constant repositioning of the chuck results in numerous changes in the longitudinal and rotary forces applied to the drill stem during the course of collecting a core sample.

A core drilling system, as disclosed in U.S. Pat. No. 3,708,020, issued to Adamson, includes a continuous feed drill assembly employing upper and lower chucks. Each chuck has a hydraulic motor for suppling of rotary motion to a drill stem via a chuck. Each chuck also uses a plurality of hydraulic cylinders to move the chucks longitudinally in alternate fashion. Thus, the upper and lower chucks of the Adamson system provide a continuous drilling motion to a drill stem. However, the operation of the hydraulically powered and actuated chucks is not well coordinated because the hydraulic control system disclosed by Adamson is incapable of fully synchronizing the upper and lower chucks. This lack of synchronization can cause the continuous feed drill assembly to apply an inconsistent drilling force and speed to the drill stem. The Adamson system also relies on limit switches to switch the roles of the two chucks, further contributing to fluctuations in the speed of the drill stem.

SUMMARY OF THE INVENTION

In one aspect of the invention, a method is provided for operating by a controller a continuous feed drill head assembly including a plurality of chucks. The controller closes an open and retracted first chuck on a drill stem and begins advancing the first chuck. The controller repeats the following steps in order to generate a continuous drilling motion. The controller determines the linear velocity of the first chuck and synchronizes the linear velocity of a retracted second chuck with the linear velocity of the first chuck. The controller closes the second chuck on the drill stem and opens the first chuck, freeing the first chuck to move without affecting the drill stem. The controller retracts the first chuck while advancing the second chuck. The controller determines the linear velocity of the second chuck and synchronizes the linear velocity of the first chuck with the linear velocity of the second chuck. The controller closes the first chuck on the drill stem and opens the second chuck, freeing the second chuck to move without affecting the drill stem. The controller retracts the second chuck while advancing the first chuck.

In another aspect of the invention, a continuous feed drilling system is provided. The continuous feed drilling system includes a rotary drive. First and second chucks are slidably coupled to the rotary drive. First and second linear actuators are operable to slidably move respectively the first and second chucks in relation to the rotary drive. First and second linear transducers are operably coupled to the first and second chucks. A controller is operatively coupled to the first and second chucks, the first and second linear actuators, and the first and second linear transducers. The controller is programmed to synchronize the first and second chucks using signals received from the first and second linear transducers.

In another aspect of the invention, the controller of the continuous feed drilling system is further programmed to repetitively determine a linear velocity of a closed chuck, synchronize the linear velocity of an open chuck with the linear velocity of the closed chuck, close the open chuck and open the previously closed rotary, and simultaneously advance the closed chuck while retracting the open chuck.

BRIEF DESCRIPTION OF THE DRAWINGS

These and other features, aspects, and advantages of the present invention will become better understood with regard to the following description and accompanying drawings where.

DETAILED DESCRIPTION

Figure 1:
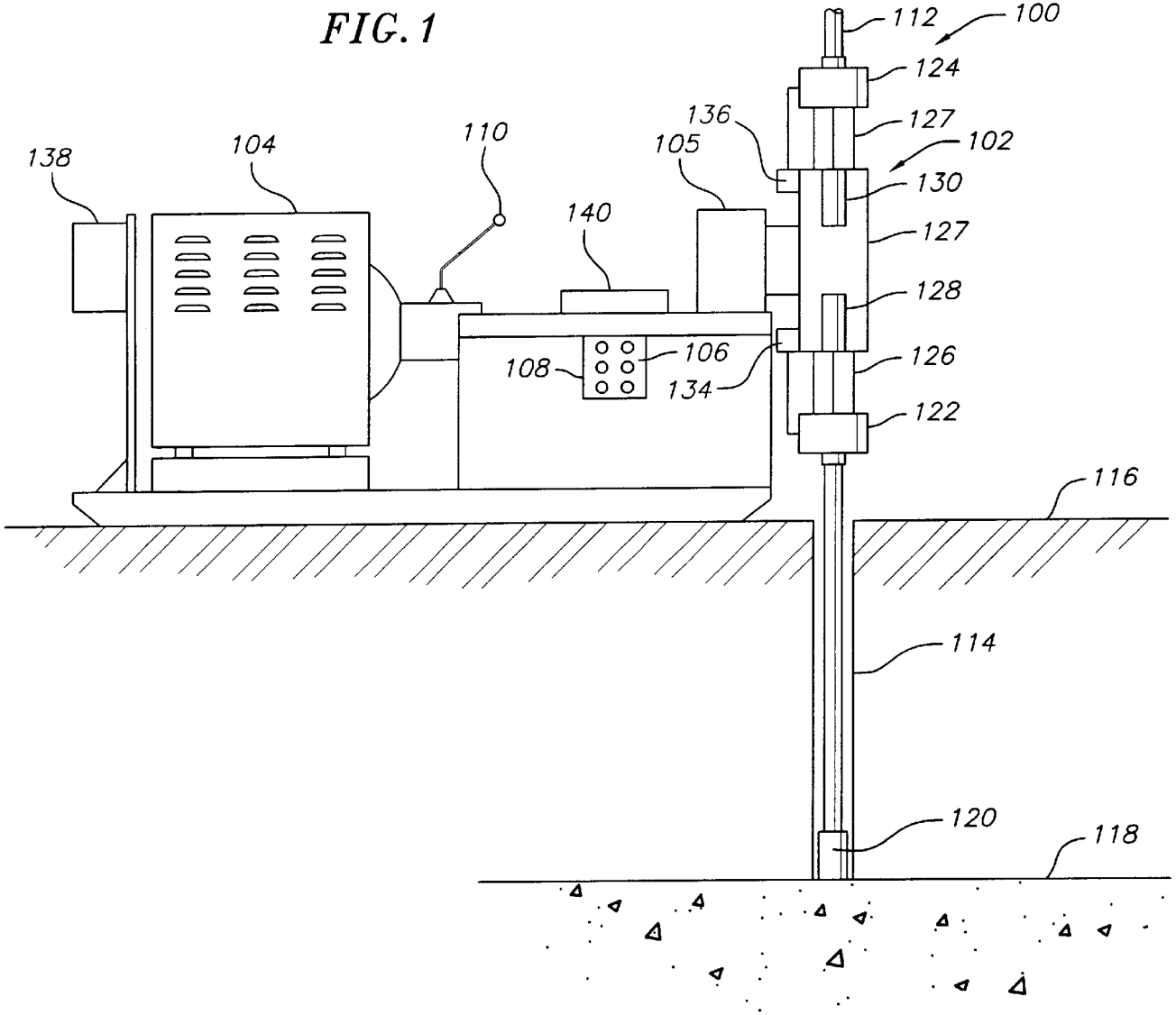
FIG. 1 is a diagrammatic view of a continuous feed drilling system constructed in accordance with an exemplary embodiment of the present invention shown in elevation.

FIG. 1 is a diagrammatic view of a continuous feed drilling system constructed in accordance with an exemplary embodiment of the present invention shown in elevation. A continuous feed drilling system includes a continuous feed drill head assembly 102 having a first chuck 122 and a second chuck 124. A drill stem 112 passes through the continuous feed drill head assembly and is engaged by the first and second chucks. The drill stem is typically advanced into a previously drilled bore hole 114 drilled through an overburden 116 to a strata of interest 118. The drill stem further includes a core drill bit 120 fixedly coupled to the drill stem.

In operation, an operator uses a user input panel 108 to open both of the chucks and the operator inserts a drill stem 112 axially through them. The operator then closes both chucks. The operator selects a penetration rate for the drill bit and feed direction and initiates rotation of the chucks. The operator continues to monitor the continuous feed drilling system using a user display 106. Depending on where the chucks are in a continuous drilling cycle, one chuck opens and the other chuck remains closed. The closed chuck advances in the selected feed direction at the selected penetration rate. As the closed chuck advances, the open chuck retracts until the open chuck reaches a specified limit near the end of the open chuck's stroke in the retracted direction.

When the closed chuck reaches a specified advancement limit near the end of the closed chuck's stroke in the feed direction, the open chuck begins moving in the selected feed direction until the open chuck's linear velocity matches the actual linear velocity of the closed chuck. The open chuck then closes and continues to advance while The previously closed chuck opens and retracts. The process repeats indefinitely, thus providing a continuous drilling motion.

The continuous feed drill head assembly further includes a rotary drive 121 operatively coupled to a power source 104 via a transmission 105. The first and second chucks are slidably coupled to the rotary drive via a first keyed drive rod 126 and a second keyed drive rod 127 respectively. Each keyed drive rod is fixedly coupled to the keyed drive rod's corresponding chuck. In operation, the rotary drive rotates the keyed drive rods causing the chucks to rotate. As the keyed drive rods are coupled to the same rotary drive, the rotational velocities of the chucks are synchronous regardless of the linear positioning of the chucks.

The first chuck is moveably coupled to the rotary drive via a first set of linear actuators such as hydraulic feed cylinders 128. The first set of hydraulic feed cylinders is operable to slidably move the first chuck in relation to the rotary drive. The second chuck is moveably coupled to the rotary drive via a second set of hydraulic feed cylinders 130. The second set of hydraulic feed cylinders is operable to slidably move the second chuck in relation to the rotary drive.

A first linear transducer 134 extends between the first chuck and the rotary drive. The first linear transducer generates a signal proportional to the position of the first chuck. A second linear transducer 136 extends between the first chuck and the rotary drive. The second linear transducer generates a signal proportional to the position of the second chuck. A suitable linear transducer is Model #BTL-5-A11-M0178-P-K05 manufactured by Balluff Inc. of Florence, Ky.

A controller 138 is operatively coupled to the continuous feed drill head assembly via valves and pressure transducers included in a hydraulic control system 140. The controller receives user input signals from the user input panel and utilizes those signals to initiate and terminate the controller's operation of the continuous feed drill head assembly. The controller further supplies electrical control signals to servo control valves included in the hydraulic control system. The control signals are transduced by the hydraulic control system into hydraulic control signals and power inputs to actuate the continuous feed drill head assembly.

The continuous feed drilling system rests on the overburden and the overburden is above the strata of interest. This relationship is exemplary in that the continuous feed drilling system can be operated in any relationship with respect to the overburden and strata of interest. For example, the continues feed drilling system can be configured to operate in a horizontally oriented bore hole, or a bore hole above the continuous feed drilling system, as might be required in a cave or an underground mine. In the exemplary relationship, the drill stem is advanced down into the bore hole in order to reach the strata of interest.

In the exemplary relationship, "penetration rate" is herein defined as the linear velocity at which a drill bit attached to the drill stem penetrates the strata of interest. The penetration rate of the drill bit is determined by the linear velocity of a chuck engaged to the drill stem.

In the exemplary relationship, "advancing a chuck" is herein defined as moving a chuck such that the drill stem is fed into the bore hole or the drill bit penetrates the strata of interest. In the exemplary relationship, the first chuck is advanced by moving the first chuck away from the rotary drive in order to feed the drill stem into the bore hole. In a like manner, the second chuck is advanced by moving the second chuck toward the rotary drive to feed the drill stem into the bore hole.

In the exemplary relationship, "retracting a chuck" is herein defined as moving a chuck opposite to its advancing direction. In the exemplary relationship, the first chuck is retracted by moving the first chuck toward the rotary drive. In a like manner, the second chuck is retracted by moving the second chuck away from the rotary drive.

Figure 2:
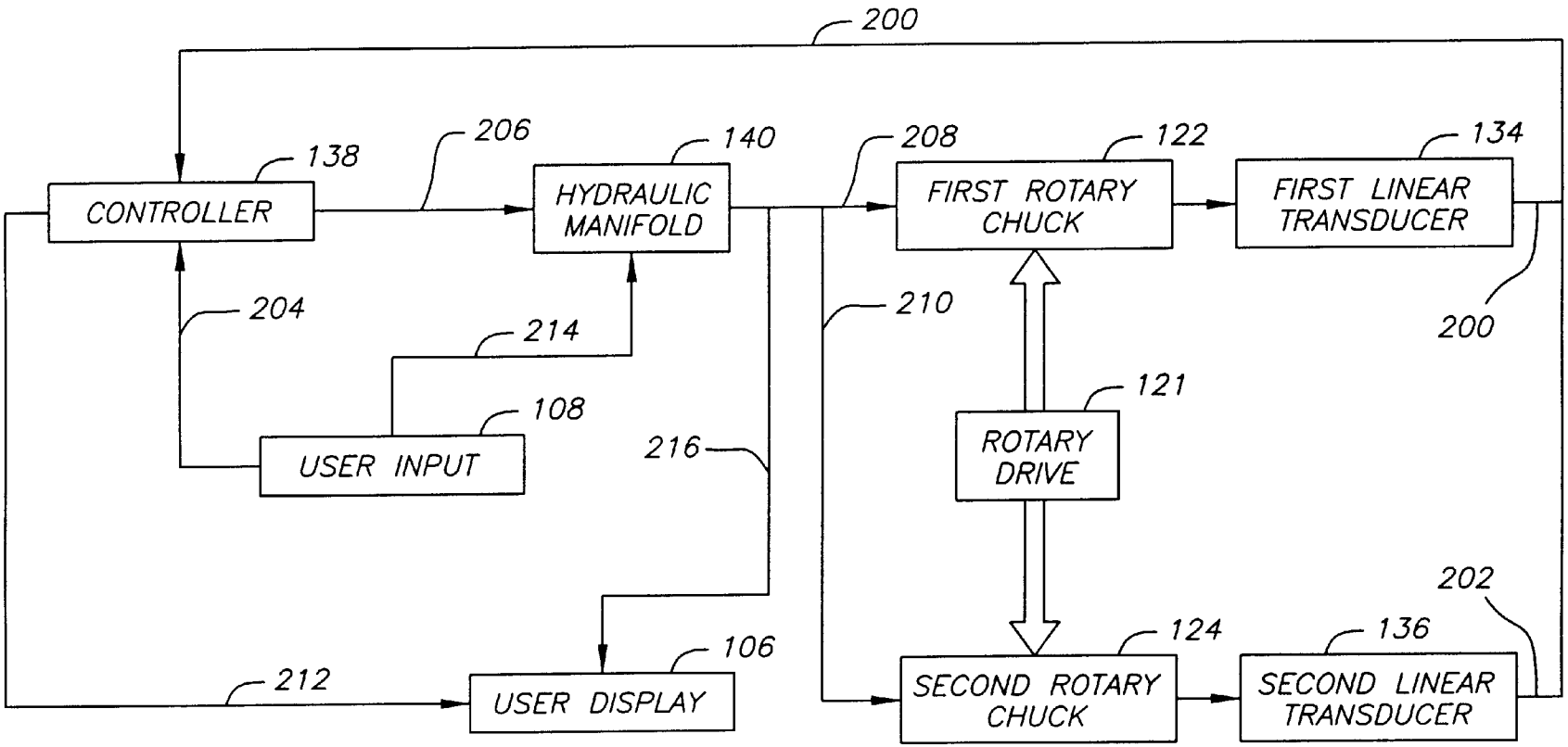
FIG. 2 is a block diagram of an exemplary control system for a continuous feed drill head assembly in accordance with the present invention.

FIG. 2 is a block diagram of an exemplary control system for a continuous feed drill head assembly in accordance with the present invention. A first linear transducer 134 is operably coupled to a controller 138. The first linear transducer generates a first position signal 200 in response to the movement of a first chuck 122. The first position signal is transmitted to the controller. A second linear transducer 136 is operably coupled to the controller. The second linear transducer generates a second position signal 202 in response to the movement of a second chuck 124. The second position signal is transmitted to the controller. A user input panel 108 includes switches for generating user input signals 204 that are transmitted to the controller.

The controller receives the first and second position signals, and the user input signals, and uses the signals to generate continuous feed drill head assembly control signals 206. The continuous feed drill head assembly control signals are transmitted to a hydraulic control system 140. The hydraulic control system uses the continuous feed drill head assembly control signals to generate first chuck hydraulic control signals 208 and transmits the first chuck hydraulic control signals to the first chuck. Additionally, the hydraulic control system uses the continuous feed drill head assembly control signals to generate second chuck hydraulic control signals 210 and transmits the second chuck hydraulic control signals to the second chuck. The controller also generates user display signals 212 and transmits them to a user display panel 106. The user display uses the user display signals to generate a user display for use by a user.

The user input panel and the user display panel are operably coupled to the hydraulic control system. The user input panel includes valves for generating hydraulic user input signals 214 that are transmitted to the hydraulic control system. The hydraulic control system also generates hydraulic user display signals 216 that are transmitted to the user display panel.

Figure 3:
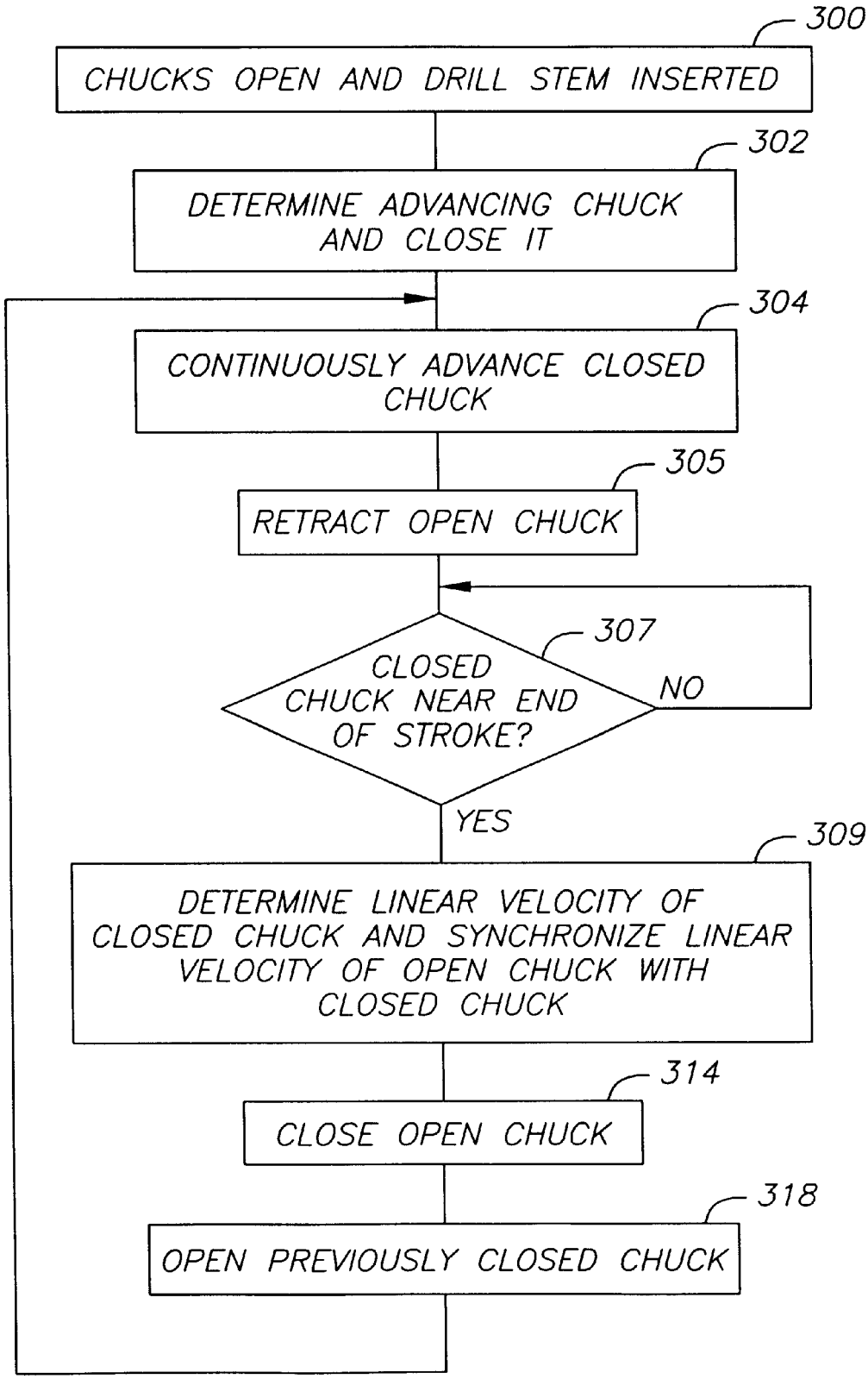
FIG. 3 is a process flow diagram describing an exemplary operational sequence of a continuous feed drill head assembly in accordance with the present invention.

FIG. 3 is a process flow diagram describing an exemplary operational sequence of a continuous feed drill head assembly in accordance with the present invention. The process starts 300 with first and second chucks 122 and 124 open and a drill stem 112 inserted in a continuous feed drill head assembly 102 (all of FIG. 1). The controller determines (302) which chuck is to be advanced and which is to be retracted. The controller closes the chuck to be advanced so that the drill stem is engaged by the advancing chuck.

The controller simultaneously advances (304) the advancing chuck and retracts (305) the retracting chuck. The advancing chuck continues to move during the controller's processing of the retracting chuck. Once the retracting chuck is fully retracted, the processor monitors the position of the advancing chuck using the previously described corresponding linear transducer 134 or 136 (both of FIG. 2) to determine the position of the advancing chuck. When the controller determines (307) that the advancing chuck reaches a specified limit near the end of the advancing chuck's stroke in the feed direction, the controller starts advancing the retracted chuck in the feed direction.

Once the retracted chuck is moving in the feed direction, the controller determines (309) the actual linear velocity of the advancing chuck using the corresponding linear transducer. The controller synchronizes the linear velocity of the retracted chuck with the linear velocity of the advancing chuck using the retracted chuck's corresponding linear transducer. At this point, the linear velocities of the chucks are synchronized. The controller closes (314) the retracted chuck resulting in both the chucks being closed with their linear velocities synchronized. The controller then determines (318) which chuck is to be the new retracting chuck and opens the new retracting chuck.

The controller repeats the above-described sequence of operations indefinitely from operation 304 thus generating a continuous advancement of the drill stem into a bore hole.

Figure 4:
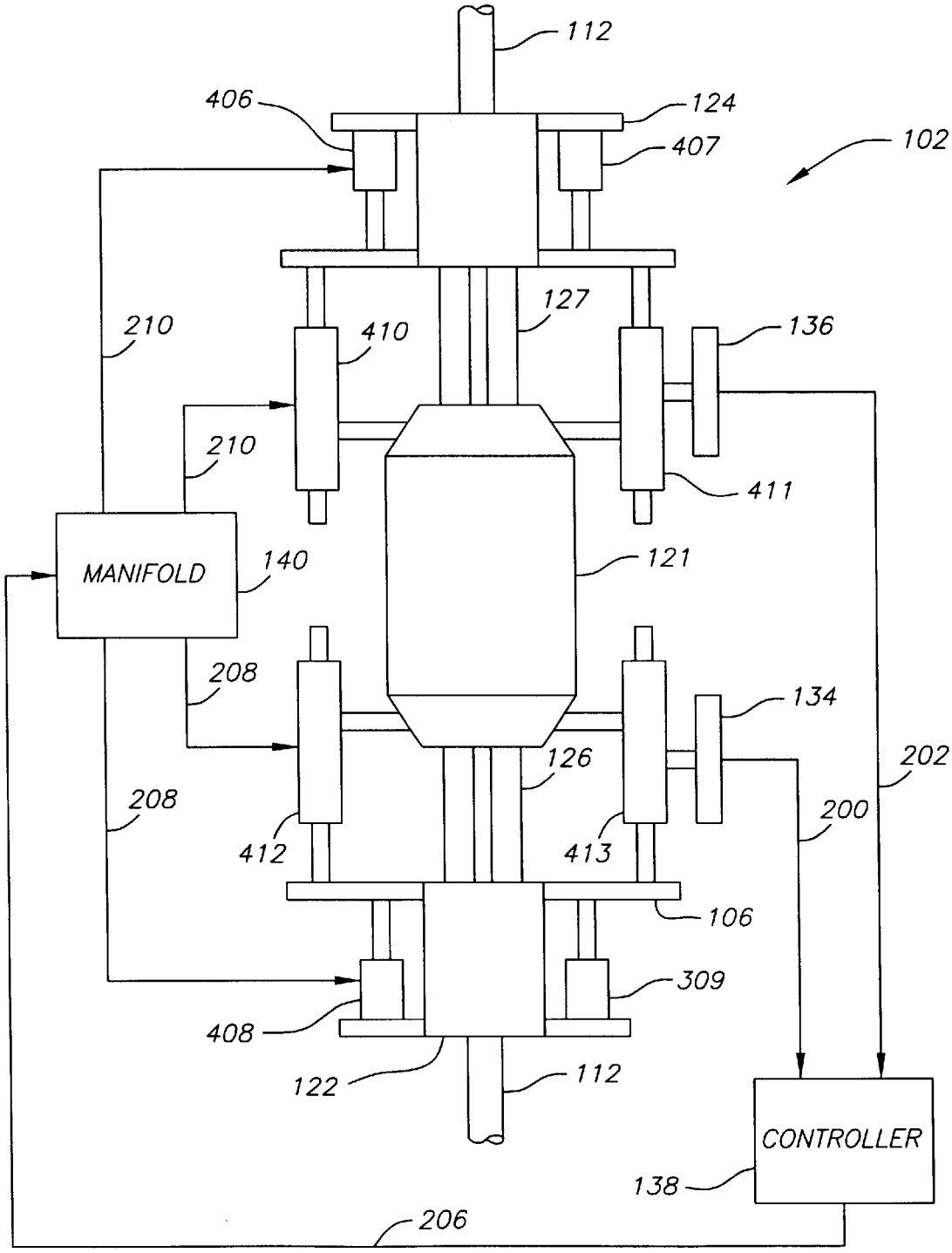
FIG. 4 is a diagram of an exemplary continuous feed drill head assembly in accordance with the present invention.

In one embodiment of a continuous feed drilling system control process in accordance with the present invention, the closed chuck is advanced to substantially 1" of the end of its stroke in the feed direction before the controller synchronizes the linear velocity of the open chuck with the linear velocity of the closed chuck. FIG. 4 is a diagram of one form of continuous feed drill head assembly in accordance with the present invention. A continuous feed drill head assembly 102 includes a first chuck 122 and a second chuck 124. A first keyed drive rod 126, rotatably coupled to the first chuck, and a second keyed drive rod 127, rotatably coupled to the second chuck, are slidably coupled to a rotary drive 121. A drill stem 112 passes through the second chuck, an interior portion (not shown) of the second keyed drill rod, an interior portion (not shown) of the first keyed drill rod, and through the first chuck. Application of a rotary force to the keyed drive rods by the rotary drive causes the chucks to apply a rotary force to an engaged drill stem. Furthermore, rotational velocity of the keyed drill rods, and thus the chucks, is synchronous because the keyed drill rods are driven by the same rotary drive.

The first chuck is coupled to the rotary drive for relative translational motion by a plurality of first hydraulic feed cylinders 408 and 409. The second chuck is moveably coupled to the rotary drive via a plurality of second chuck actuators 410 and 411. In an embodiment of a continuous feed drill head assembly in accordance with the present invention, the hydraulic feed cylinders have dual rods fixedly attached to a single piston slidably housed within an interior portion (not shown) of the hydraulic cylinders.

The chucks may be moved longitudinally in relation to the rotary drive by a differential in pressurization on each side of the piston. For example, higher pressurization of the chuck side of one of the hydraulic feed cylinders causes a chuck to move closer to the rotary drive. Conversely, higher pressurization of the rotary drive side of one of the hydraulic feed cylinders causes the corresponding chuck to move away from the rotary drive. In this way, the position of each of the chucks relative to the rotary drive may be controlled.

In an embodiment of a continuous feed drilling system in accordance with the present invention, the chucks are moved in relation to the rotary drive via servo valves coupled to each side of the piston in the hydraulic feed cylinders. During movement of a chuck, there is always pressure on both sides of the piston. A top side of the piston is coupled to a "pull down gauge" and a bottom side of the piston is coupled to a "hold back gauge". A differential pressure as determined by reading these two gauges may be used by an operator to determine a relative bit weight on a bit. When the differential pressure is higher on the top side of the piston, the continuous feed drilling system is operating in the pull down mode. When the differential pressure is higher on the bottom side of the piston, the continuous feed drilling system is operating in the hold back mode (that is applying pressure to the lower side of the cylinder to hold back a fraction of the string weight).

Rotary motion is imparted to the two chucks by the rotary drive via keyed drive rods. A keyed drive rod is slidably coupled to the rotary drive and fixedly coupled to the chuck. As the keyed rod moves with the chuck, it slides within the rotary drive. In this way, rotary motion can be applied to a chuck by the rotary drive anywhere along the chuck's stroke as the chuck is moved either closer to or further from the rotary drive. Finally, because each chuck has its own hydraulic feed cylinder(s), the relative position of the chucks from the rotary drive my be independently adjusted by pressurizing the appropriate hydraulic feed cylinder(s).

Forces are applied to a drill stem using the hydraulic feed cylinders. As previously described, a chuck may be engaged with the drill stem such that the drill stem is rotated by the chuck. Movement of the chuck relative to the rotary drive also causes the drill stem engaged by the chuck to move longitudinally relative to the rotary drive. In a like manner, any force applied to the chuck will be applied to the drill stem engaged to the chuck. In this way, a continuous feed drilling system can apply forces to a drill stem in order to force a drill bit fixedly coupled to the drill stem against a strata of interest.

A continuous feed drill head assembly further includes a first linear transducer 134 coupled between the rotary drive and the first chuck and a second linear transducer 136 coupled between the rotary drive and the second chuck. The linear transducers generate position signals, 200 and 202, proportional to the position of the chucks. The position signals are received by a controller 138 operably coupled to the linear transducers. The controller uses the position signals to generate continuous feed drill head assembly control signals 206 that are transmitted to a hydraulic control system 140. The hydraulic control system receives the continuous feed drill head assembly control signals and uses them to generate chuck hydraulic control signals 208 and 210 and transmits the chuck hydraulic control signals to the actuators included in the continuous feed drill head assembly.

Figure 5:
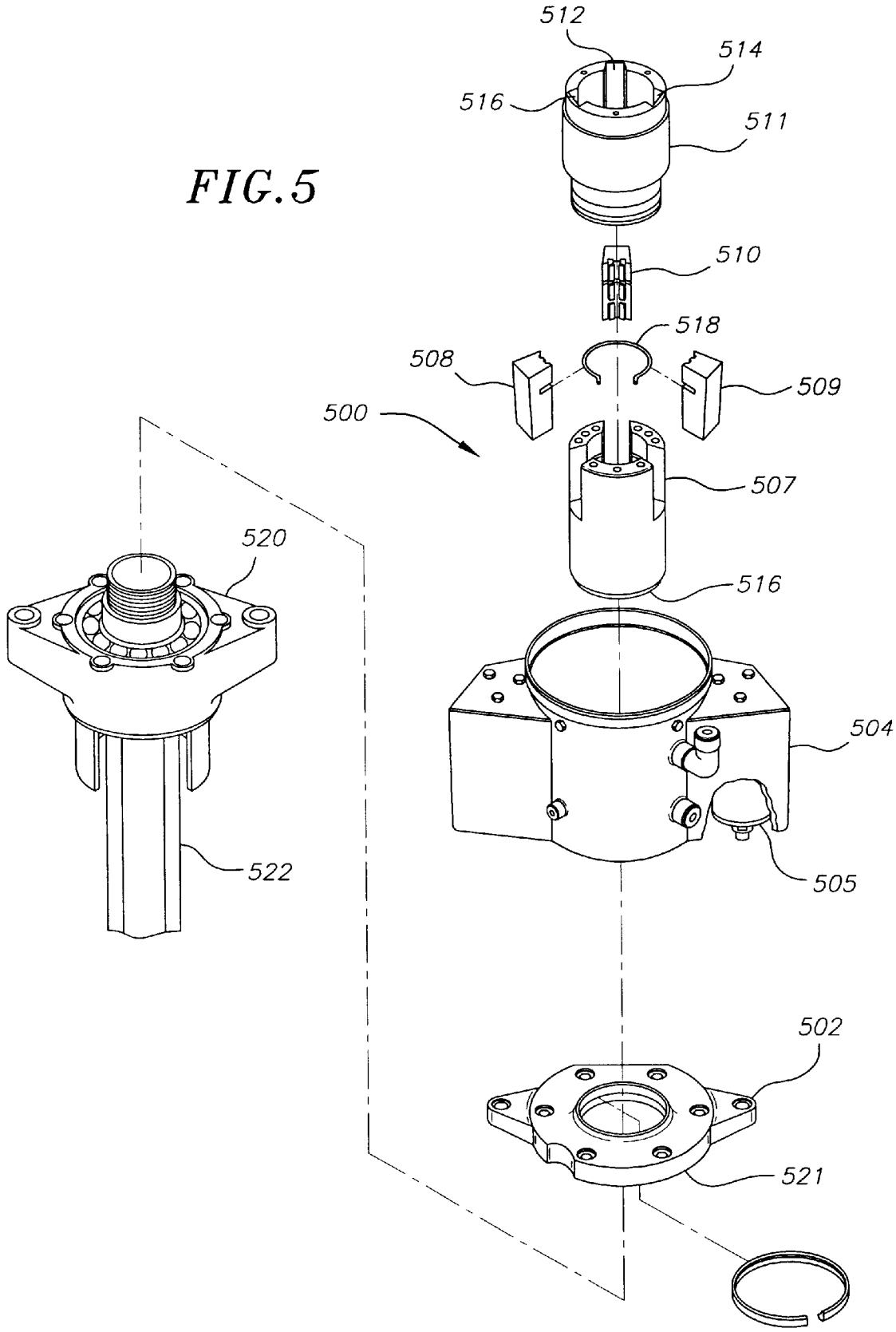
FIG. 5 is an exploded perspective view of an exemplary embodiment of a chuck in accordance with the present invention.

FIG. 5 is an exploded perspective view of an exemplary embodiment of a chuck in accordance with the present invention. A continuous feed drill head assembly includes a plurality of chucks. A chuck 500 includes a crosshead adapter 502 moveably attached to a chuck assembly housing 504 via a plurality of actuators 505 (one is shown). A cylinder portion of the actuator is fixedly attached to the chuck assembly housing. A first end of a rod portion of the actuator is fixedly attached to the crosshead adapter. A second end of the rod portion is fixedly attached to a rod side of a piston (not shown) slidably housed within the cylinder portion of the actuator. The piston further includes a cylinder side opposite the rod side. Pressurization of the rod side of the piston causes the crosshead adapter to move closer to the chuck assembly housing. Pressurization of the cylinder side of the piston causes the crosshead adapter to move away from the chuck assembly housing.

The chuck further includes a drive rod adapter 507 slidably and rotatably housed within the chuck assembly housing. A plurality of tapered jaws 508, 509, and 510, are moveably coupled to the drive rod adapter. The plurality of tapered jaws and drive rod adaptor are slidably housed within an inner sleeve 511. The inner sleeve includes a plurality of tapered interior grooves 512, 514, 516 corresponding to the plurality of tapered jaws. In operation, a traction force applied to a base portion 512 of the drive rod adapter causes the tapered jaws to slide along the tapered interior grooves of the inner sleeve such that the jaws close by moving closer together. A drill stem (not shown) passing through the drive adaptor can thus be engaged by the closed tapered jaws. Removal of the traction force causes the tapered jaws to open by moving further apart in response to the force of a jaw retraction spring 518. In this way, the drill stem can be selectively engaged and released by applying and relaxing traction forces to the base portion of the rod adaptor causing the jaws to close and open.

A chuck further includes a crosshead 520 fixedly coupled to a bottom portion 521 of the crosshead adaptor. The crosshead adaptor is rotatably coupled to a keyed drive rod 522. The keyed drive rod passes through the crosshead and is fixedly attached to the base portion of the drive rod adapter. Pressurization of the cylinder side of the piston slidably housed in the cylinder of the actuator causes the crosshead to move further from the chuck assembly housing. Additionally, such pressurization generates a traction force which is applied to the base portion of the drive rod adaptor by the keyed drive rod rotatably coupled to the crosshead. In this manner, pressurization of the actuator allows the chuck to selectively clamp on to a drill stem. Subsequent rotation of the keyed drive rod causes rotation of the engaged drill stem. Release of pressure results in release of the drill stem. Once released, rotation of the keyed drive rod does not result in rotation of the drill stem.

Figure 6:
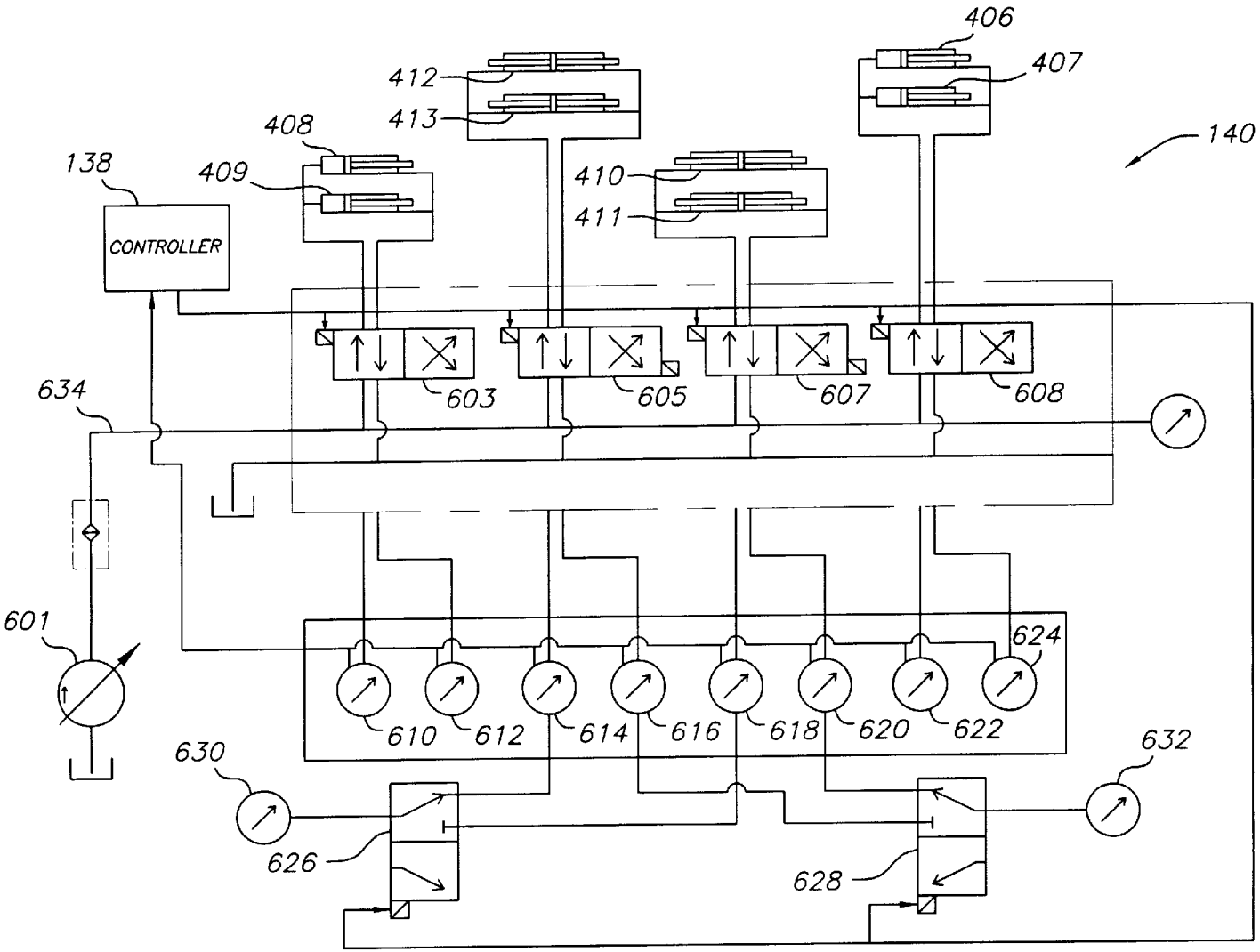
FIG. 6 is a schematic of an exemplary hydraulic control system for controlling a continuous feed drill head assembly in accordance with the present invention.

FIG. 6 is a schematic of an exemplary hydraulic control system for controlling a continuous feed drill head assembly in accordance with the present invention. A hydraulic control system 140 includes a plurality of hydraulic control valves 603, 605, 607, and 608. Each of the hydraulic control valves is electrically coupled to a controller 138. Each of the hydraulic control valves is hydraulically coupled to a hydraulic pump 601.

A first actuator control valve 603 is operably coupled to previously described first chuck actuators 408 and 409. In a first position, the first actuator control valve pressurizes the first chuck actuators such that a first chuck clamps on to a drill stem as previously described. In a second position, the first actuator control valve pressurizes the first chuck actuators such that the first chuck releases the engaged drill stem as previously described.

A second actuator control valve 608 is operably coupled to previously described second chuck actuators 410 and 411. In a first position, the second actuator control valve pressurizes the second chuck actuators such that a second chuck clamps on to a drill stem as previously described. In a second position, the second actuator control valve pressurizes the second chuck actuators such that the second chuck releases the engaged drill stem as previously described.

A first servo control valve 605 is operably coupled to previously described first hydraulic feed cylinders 412 and 413. In a first position, the first servo control valve pressurizes the first hydraulic feed cylinders such that a first chuck is advanced. In a second position, the first servo control valve pressurizes the first hydraulic feed cylinders such that the first chuck is retracted.

A second servo control valve 607 is operably coupled to previously described second hydraulic feed cylinders 410 and 411. In a first position, the second servo control valve pressurizes the second hydraulic feed cylinders such that a second chuck is advanced. In a second position, the second servo control valve pressurizes the second hydraulic feed cylinders such that the second chuck is retracted.

The hydraulic control system further includes a plurality of pressure transducers 610, 612, 614, 616, 618, 620, 622, and 624. The pressure transducers are each electrically coupled to the controller.

A first drill stem engaged pressure transducer 612 is hydraulically coupled to first chuck actuators 409 and 408. The first drill stem engaged pressure transducer generates a first drill stem engaged signal when pressure is applied to the first chuck actuators such that the first chuck clamps on to a drill stem as previously described. A first drill stem released pressure transducer 610 is hydraulically coupled to first chuck actuators 409 and 408. The first drill stem released pressure transducer pressure transducer generates a first drill stem released signal when pressure is applied to the first chuck actuators such that the first chuck will release an engaged drill stem as previously described.

A second drill stem engaged pressure transducer 624 is hydraulically coupled to second chuck actuators 406 and 407. The second drill stem engaged pressure transducer generates a second drill stem engaged signal when pressure is applied to the second chuck actuators such that the second chuck will clamp on to a drill stem as previously described. A second drill stem released pressure transducer 622 is hydraulically coupled to second chuck actuators 406 and 407. The second drill stem released pressure transducer generates a second drill stem released signal when pressure is applied to the second chuck actuators such that the second chuck will release an engaged drill stem as previously described.

The controller receives the first and second drill stem engaged and released signals transmitted from pressure transducers 610, 612, 622, and 624. The controller uses the first and second drill stem engaged and released signals to determine which chuck is currently engaged onto the drill stem. Additionally, the controller can generate error signals using the first and second drill stem engaged and released signals. For example, if the controller energizes a chuck's actuator control valve such that the chuck should release an engaged drill stem and the controller does not receive a corresponding drill stem released signal, then the controller can generate an error signal indicating a malfunction somewhere in the hydraulic system.

A first advance pressure transducer 618 is operably coupled to first hydraulic feed cylinders 410 and 411. The first advance pressure transducer generates a first advance signal when pressure is applied to the first hydraulic feed cylinders such that a first chuck is advanced as previously described. A first retract pressure transducer 620 is hydraulically coupled to previously described first hydraulic feed cylinders. The first retract pressure transducer generates a first retract signal when pressure is applied to the first hydraulic feed cylinders such that the first chuck is retracted as previously described.

A second advance pressure transducer 614 is operably coupled to second hydraulic feed cylinders 412 and 413. The second advance pressure transducer generates a second advance signal when pressure is applied to the second hydraulic feed cylinders such that a second chuck is advanced as previously described. A second retract pressure transducer 616 is hydraulically coupled to the second hydraulic feed cylinders. The second retract pressure transducer generates a second retract signal when pressure is applied to the second hydraulic feed cylinders such that the second chuck is retracted as previously described.

An exemplary continuous feed drilling system in accordance with the present invention includes a user interface that mimics a user interface for a drill with a single chuck. The hydraulic control system further includes an advance pressure gauge 630, known in the art as a "pull down gauge". The advance pressure gauge is operatively coupled to an advance pressure selection valve 626. The advance pressure selection valve is hydraulically coupled to previously described first advance pressure transducer 620 and second advance pressure transducer 614. The advance pressure selection valve is electrically coupled to previously described controller 138. The controller transmits advance pressure selection signals (not shown) to the advance pressure selection valve in order to selectively apply pressure to the advance pressure gauge. In this manner, the controller can apply to the advance pressure gauge an advance pressure of previously described advanced chuck 122 (FIG. 1).

The hydraulic control system further includes a retract pressure gauge 632, known in the art as a "hold back gauge". The retract pressure gauge is operatively coupled to a retract pressure selection valve 628. The retract pressure selection valve is hydraulically coupled to previously described first retract pressure transducer 616 and second retract pressure transducer 620. The retract pressure selection valve is electrically coupled to the controller. The controller transmits retract pressure selection signals (not shown) to the retract pressure selection valve in order to selectively apply pressure to the retract pressure gauge. In this manner, the controller can apply to the retract pressure gauge a retract pressure of the retracting chuck.

The retract pressure selection valve and the advance pressure selection valve couple the pull down and hold back gauges to the set of hydraulic feed cylinders that are actually doing the drilling. Whenever the drilling is handed off from one chuck to the other chuck that was previously idle, the retract pressure selection valve and the advance pressure selection valve shift and expose the gauges to the ports of the previously idle chuck's corresponding hydraulic feed cylinders. At this point the previously idle chuck closes and begins to move under the influence of its corresponding hydraulic feed cylinders.

In an embodiment of a continuous feed drilling system in accordance with the present invention, the hydraulic feed cylinders have dual rods. This results in both sides of each piston within a hydraulic feed cylinder having equal amounts of surface area exposed to the pressurized hydraulic fluid. In this embodiment, the pressure values on the pull down and hold back gauges do not change when the retract pressure selection valve and the advance pressure selection valve shift from one set of hydraulic feed cylinders to the other.

If during operation the drill stem encounters an impenetrable object while drilling, the pressure in the pull down gauge will rise and the pressure in the hold back gauge will fall. Conversely, if the drill stem is being retrieved from the bore hole, it may get stuck. In this case, the hold back pressure gauge will indicate a rise in pressure and the pull down pressure gauge will indicate a fall in pressure. In each case, the controller limits the amount of pressure rise by disabling the feed system of the continuous feed drilling system.

Figure 8:
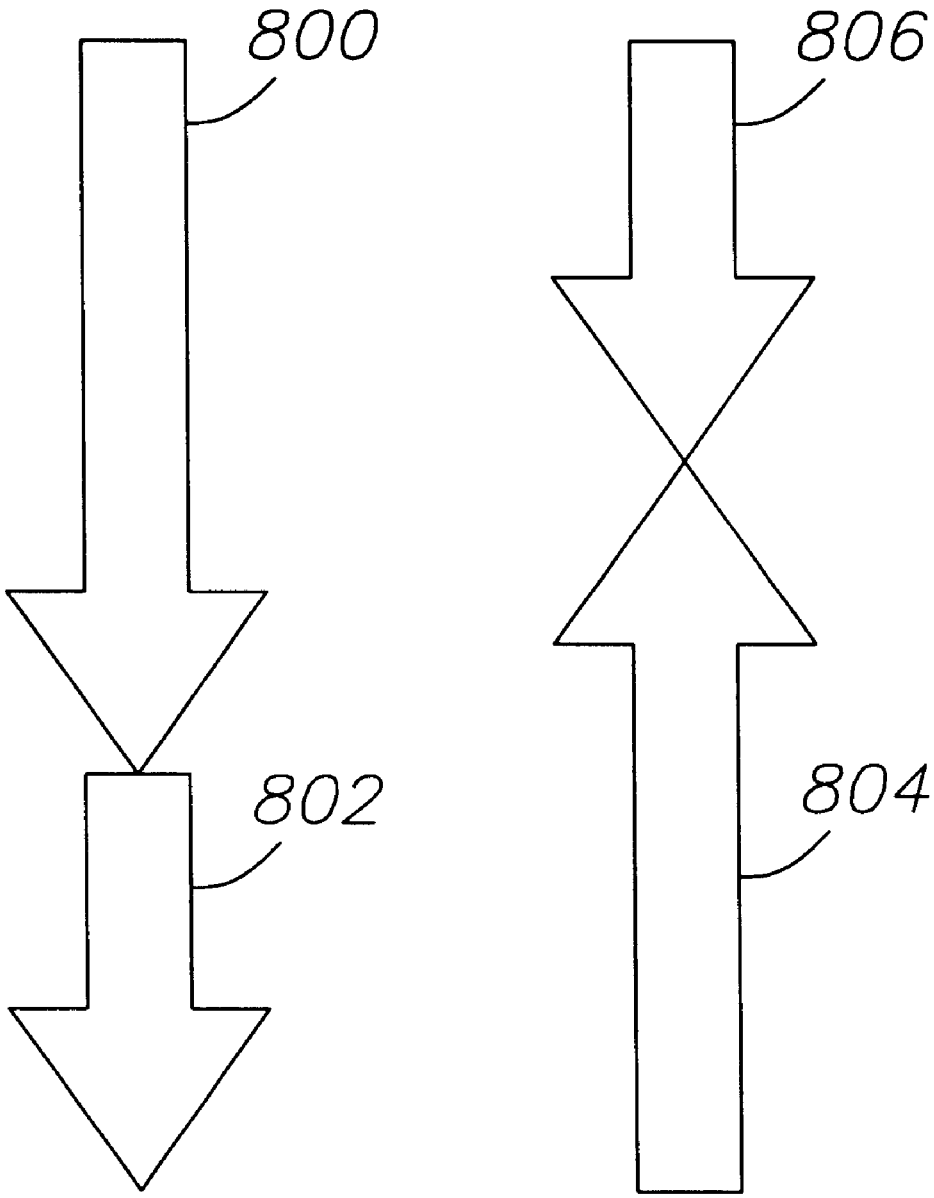
FIG. 8 is a force diagram illustrating the relationship between the hydraulic and drill stem forces associated with a continuous feed drilling system constructed in accordance with an exemplary embodiment of the present invention.

FIG. 8 is a diagram depicting the relationship between drill stem weight, hold back pressure, and pull down pressure. A drill stem force 800 is generated on a drill bit by the weight of a drill stem. This drill stem force is in the same direction as a pull down force 802 generated by a pull down pressure applied to a hydraulic feed cylinder coupled to a chuck attached to the drill stem as previously described. A hold back force 804 is generated on the drill bit by a hold back pressure applied to a hydraulic feed cylinder coupled to a chuck attached to the drill stem as previously described. The hold back force is in the opposite direction of the pull down force and the drill stem force. A resultant drill bit force 806 is thus equal to the hold back force minus the sum of the pull down force and the drill stem force. The resultant drill bit force can be expressed as a weight and is commonly termed "weight on bit" or "bit weight".

As noted above, in one embodiment of a continuous feed drilling system in accordance with the present invention, the hydraulic feed cylinders have dual rods, resulting in both sides of each piston having equal amounts of surface area exposed to pressurized fluid. As shown in FIG. 8, a resultant drill bit force 806 is in the direction of a pull down force 802 even though a hold back force 804 is greater than the pull down force. This is because of the presence of a drill stem force 800 generated by the weight of a drill stem. Thus, the embodiment having dual rod hydraulic feed cylinders, the hold back pressure can be higher than the pull down pressure and the drill bit can still advance toward the higher fluid pressure by virtue of the drill stem weight.

Figure 7:
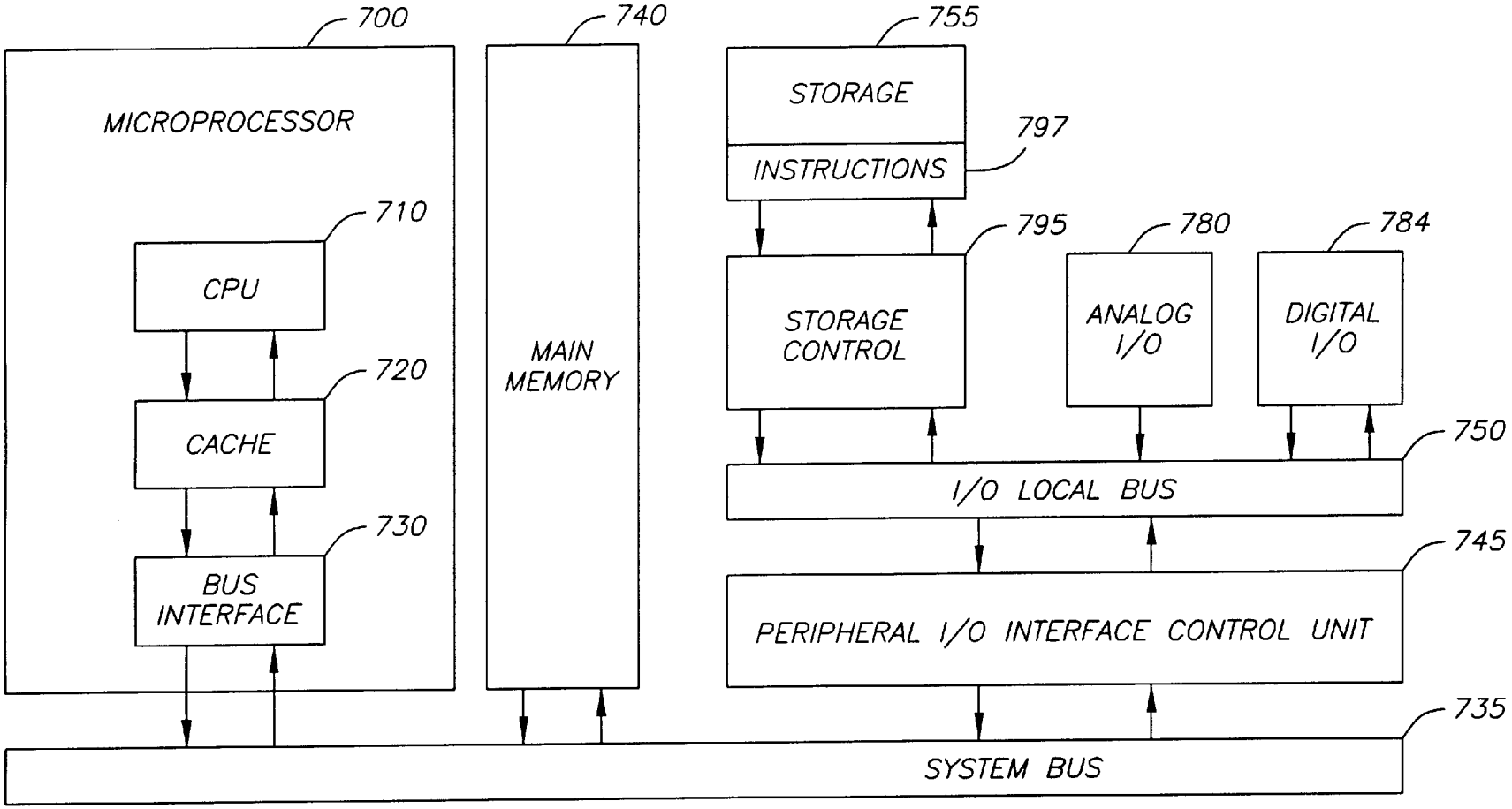
FIG. 7 is a block diagram of an exemplary architecture for a controller for controlling a continuous feed drill head assembly in accordance with the present invention.

FIG. 7 is a diagram of an architecture for an exemplary controller useful in controlling a continuous feed drill head assembly in accordance with the present invention. A microprocessor 700, including a Central Processing Unit (CPU) 710, a memory cache 720, and a bus interface 730, is operatively coupled via a system bus 735 to a main memory 740 and an I/O interface control unit 745. The I/O interface control unit is operatively coupled via an I/O local bus 750 to a memory storage controller 795.

The memory storage controller is operatively coupled to a storage device 725. Computer program instructions 797 for operating a continuous feed drilling system in accordance with the present invention are stored in the storage device. The microprocessor retrieves the computer program instructions and stores them in the main memory. The microprocessor then executes the computer program instructions stored in the main memory to implement the features of a continuous feed drilling system in accordance with the present invention.

The controller further includes an analog I/O interface 780 operatively coupled to the I/O local bus. The controller uses the analog I/O interface to receive and transmit analog signals from and to external primary sensors and final control elements. The controller further includes a digital I/O interface 784 operatively coupled to the I/O local bus. The controller uses the digital I/O interface to receive and transmit digital signals from and to external primary sensors and final control elements.

In one embodiment of a continuous feed drilling system in accordance with the present invention, an Allen Bradley SLC-503 programmable logic controller programmed in ladder logic is used to control the operations of the continuous feed drilling system.

Although this invention has been described in certain specific embodiments, many additional modifications and variations would be apparent to those skilled in the art. It is therefore to be understood that this invention may be practiced otherwise than as specifically described. Thus, the present embodiments of the invention should be considered in all respects as illustrative and not restrictive, the scope of the invention to be determined by any claims supportable by this application and the claims' equivalents.

What is claimed is:

1. A method for operating a continuous feed drill head assembly including a plurality of chucks, comprising:

closing a first chuck to engage a drill stem;

advancing the first chuck;

repeating the following steps a–h:

a) synchronizing an open second chuck's linear velocity with the closed first chuck's linear velocity;

b) closing the second chuck to engage the drill stem;

c) opening the first chuck;

d) retracting the open first chuck while advancing the closed second chuck;

e) synchronizing the open first chuck's linear velocity with the closed second chuck's linear velocity;

f) closing the first chuck to engage the drill stem;

g) opening the second chuck; and h) retracting the open second chuck while advancing the closed first chuck.

2. The method of claim 1 wherein synchronizing an open chuck's linear velocity with a closed chuck's linear velocity further includes determining the linear velocity of the closed chuck.

3. The method of claim 2, wherein each of the plurality of chucks is operably coupled to a corresponding linear transducer and determining the linear velocity of a chuck further includes:

receiving a position signal from a linear transducer corresponding to the chuck; and generating the linear velocity using the received position signal.

4. The method of claim 1, further comprising determining if the advancing closed chuck is within a specified limit near the end of the closed chuck's stroke.

5. The method of claim 4 wherein the specified limit is substantially one inch from the end of the closed chuck's stroke.

6. A controller adapted to operate a continuous feed drill head assembly including a plurality of chucks, comprising:

a processor; and a memory operably coupled to the processor and having program instructions stored therein, the processor being operable to execute the program instructions, the program instructions including:

closing a first chuck to engage a drill stem;

advancing the first chuck;

repeating the following steps a–h:

a) synchronizing an open second chuck's linear velocity with the closed first chuck's linear velocity;

b) closing the second chuck to engage the drill stem;

c) opening the first chuck;

d) retracting the open first chuck while advancing the closed second chuck;

e) synchronizing the open first chuck's linear velocity with the closed second chuck's linear velocity;

f) closing the first chuck to engage the drill stem;

g) opening the second chuck; and h) retracting the open second chuck while advancing the closed first chuck.

7. The controller of claim 6 wherein the instructions for synchronizing an open chuck's linear velocity with a closed chuck's linear velocity further include determining the linear velocity of the closed chuck.

8. The controller of claim 7, wherein each of the plurality of chucks is operably coupled to a corresponding linear transducer, the program instructions for determining the linear velocity of a chuck further including:

receiving a position signal from a linear transducer corresponding to the chuck; and generating the linear velocity using the received position signal.

9. The controller of claim 6, the program instructions further including determining if the advancing closed chuck is within a specified limit near the end of the closed chuck's stroke.

10. The controller of claim 9 wherein the specified limit is substantially one inch from the end of the closed chuck's stroke.

11. A continuous feed drilling system, comprising:

a rotary drive;

a first chuck slidably coupled to the rotary drive;

a second chuck slidably coupled to the rotary drive;

a first linear actuator operable to slidably move the first chuck in relation to the rotary drive;

a second linear actuator operable to slidably move the second chuck in relation to the rotary drive;

a first linear transducer operably coupled to the first chuck;

a second linear transducer operably coupled to the second chuck; and a controller operatively coupled to the first and second chucks, the first and second linear actuators, and the first and second linear transducers, the controller being programmed to synchronize the first and second chucks using position signals received from the first and second linear transducers.

12. The continuous feed drilling system of claim 11, wherein the controller is further programmed to determine a linear velocity of an advancing chuck and synchronize a linear velocity of a retracted chuck with the linear velocity of the advancing chuck.

13. The continuous feed drilling system of claim 12 wherein the controller is further programmed to close a retracted chuck and open an advancing chuck after the advancing and retracted chucks have been synchronized.

14. The continuous feed drilling system of claim 13 wherein the controller is further programmed to advance a closed chuck while retracting an open chuck.

15. The continuous feed drilling system of claim 14, wherein the controller is further programmed to determine if the advancing closed chuck is within a specified limit near the end of the advancing closed chuck's stroke.

16. The continuous feed drilling system of claim 15 wherein the specified limit is substantially one inch from the end of the advancing closed chuck's stroke.

17. The continuous feed drilling system of claim 11 wherein the controller is further programmed to repetitively determine a linear velocity of an advancing chuck, synchronize a linear velocity of a retracted chuck with the linear velocity of the advancing chuck, close the retracted chuck and open the advancing chuck after the advancing and retracted chucks have been synchronized, and advance the closed chuck while retracting the open chuck.

18. A method for operating a continuous feed drilling system including a plurality of chucks, comprising:

repeating the following steps:

synchronizing a retracted chuck's linear velocity with the linear velocity of an advancing chuck engaged with a drill stem;

closing the retracted chuck to engage the drill stem;

opening the advancing chuck; and simultaneously advancing the now closed chuck and retracting the now open chuck whereby the previously retracted chuck becomes the advancing chuck and the previously advancing chuck becomes the retracted chuck.

19. The method of claim 18, further comprising determining the linear velocity of the advancing chuck.

20. The method of claim 19, wherein each of the plurality of chucks is operably coupled to a corresponding linear transducer and determining the linear velocity of a chuck further includes:

receiving a position signal from a linear transducer corresponding to the chuck; and generating the linear velocity using the received position signal.

21. The method of claim 19, further comprising determining if the advancing closed chuck is within a specified limit near the end of the closed chuck's stroke.

22. The method of claim 21 wherein the specified limit is substantially one inch from the end of the closed chuck's stroke.

* * * * *